US006199501B1

(12) United States Patent
Kuhlman

(10) Patent No.: US 6,199,501 B1
(45) Date of Patent: Mar. 13, 2001

(54) ARTICULATED TUG AND BARGE MOBILE LIGHTERING CONNECTION

(75) Inventor: Clare J. Kuhlman, Riverside, MO (US)

(73) Assignee: Intercontinental Eng. Mfg. Corp., Riverside, MO (US)

( * ) Notice: Subject to any disclaimer, the term of this patent is extended or adjusted under 35 U.S.C. 154(b) by 0 days.

(21) Appl. No.: 09/302,307

(22) Filed: Apr. 30, 1999

(51) Int. Cl.[7] ..... B63B 21/56
(52) U.S. Cl. ..... 114/248
(58) Field of Search ..... 114/230.1, 230.16, 114/242, 246–252

(56) References Cited

U.S. PATENT DOCUMENTS

| | | | | |
|---|---|---|---|---|
| 3,461,829 | * | 8/1969 | Mosvold | 114/246 |
| 3,645,225 | * | 2/1972 | Lunde | 114/249 |
| 4,688,507 | * | 8/1987 | Kuhlman et al. | 114/249 |
| 5,050,522 | * | 9/1991 | Yamaguchi et al. | 114/248 |

* cited by examiner

*Primary Examiner*—Ed Swinehart
(74) *Attorney, Agent, or Firm*—Spencer Fane Britt & Browne LLP

(57) ABSTRACT

A barge mounted, vertically adjustable receiver is provided which allows connection of a tug boat or pusher boat to a barge and which permits compensation to be made for changes in the draft of the barge by changing the vertical position of the receiver on the barge without disconnection the boat and barge.

33 Claims, 8 Drawing Sheets

FIG. 3
(PRIOR ART)
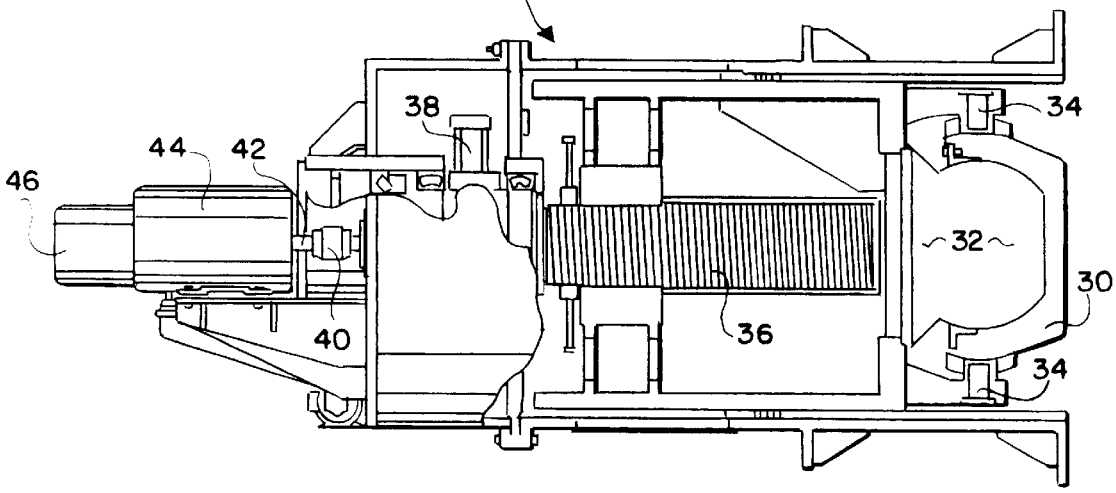
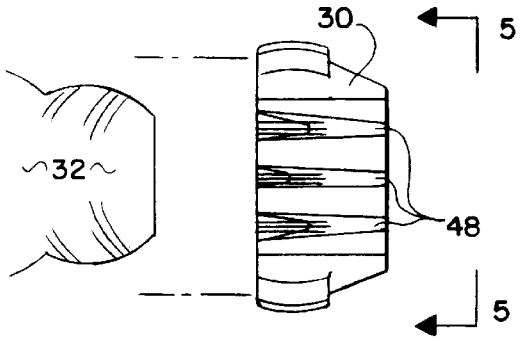
FIG. 4
(PRIOR ART)
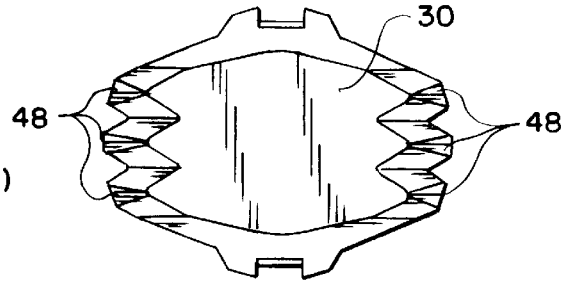
FIG. 5
(PRIOR ART)

ARTICULATED TUG AND BARGE MOBILE LIGHTERING CONNECTION

BACKGROUND OF THE INVENTION

This invention relates to the field of marine transport and more specifically to barge cargo transport. In particular, the present invention relates to connected or articulated tug and barge units, also known as articulated pusher boat and barge units used in the transport of petroleum products and other commodities.

Referring to FIGS. 1 and 2, the operation of the prior art arrangements between articulated tug and barge vessels will be described. In FIG. 1, tugboat 14 is shown approaching the stern of barge 10. In the stern of barge 10 is notch or well 12 which is sized to receive the bow of tugboat 14. Tugboat or pusher boat 14 approaches the stern of barge 10 and positions itself within notch 12 such that coupling unit 16, 16' of tugboat 14 aligns with vertical channels 18, 18' on barge 10. Once tugboat or pusher boat 14 is properly seated within notch or well 12 of barge 10, alignment is achieved between coupling unit 16, 16' and vertical channels 18, 18' at which time coupling unit 16, 16' is extended by the pusher boat operator to engage with teeth 28 of vertical channel 18 and teeth 28' (not shown) of vertical channel 18'. The advantages of this interconnection between the pusher boat or tugboat 14 and barge 10 are that the boat and barge are securely connected, and boat 14 has far greater control over the acceleration and deceleration of barge 10 and greater control over the direction of travel than would be available to the tug if tow lines were being used to pull the barge through the water.

One means for making the connection between boat 14 and barge 10 is through the use of a coupling unit as shown in FIG. 3. Coupling unit 16 of FIG. 3 operates to secure boat 14 to barge 10 through use of screw drive 36 which extends coupling unit helmet 30 outwardly from the side of boat 14 to connect with teeth 28 of vertical channels 18, 18' (FIG. 1). The operation of the particular coupling unit shown in FIG. 3 is fully discussed in U.S. Pat. No. 4,688,507 to Kuhlman, et al., and that patent specification is incorporated herein by reference.

Still referring to FIG. 3, the general operation of coupling unit 16 will be discussed. Once the pilot has navigated boat 14 into notch or well 12 of barge 10, cast component or helmet 30 of coupling unit 16 is extended toward vertical channels 18, 18' (FIG. 1). The extension of helmet 30 is initiated by operation of screw 36 which has steel ball 32 attached to one end and on which helmet 30 can pivot. The extension and retraction of screw 36 is operated by use of either low speed electric motor 46 or high speed electric motor 44. In the case of high speed electric motor 44, the force from motor 44 is communicated by shaft 42 to gear 38, the rotation of which causes rotation of screw 36. Rotation of screw 36, depending on the direction selected, will either extend or retract steel ball 32 and helmet 30 which are attached to screw 36. Referring now to FIGS. 4 and 5, the configuration of helmet or cast component 30 is shown. Helmet 30 is designed such that teeth 48 of helmet 30 engage teeth 28 of vertical channels 18, 18' of barge 10 (FIG. 1). It will be appreciated that upon extension of screw 36 of coupling unit 16 (FIG. 3) to bring helmet 30 in contact with vertical channels 18, 18' that teeth 48 of helmet 30 will engage with four of teeth 28 on the fore and aft sides of vertical channels 18, 18'. This design provides six faces of contact between helmet 30 and vertical channels 18, 18' thereby providing a very secure interconnection with a minimum of vertical play between the vertical channels 18, 18' and coupling units 16, 16'.

The manner of coupling tug and barge units just described provides a secure, dependable interconnection between a tug or pusher boat 14 and barge 10 and offers far greater control and maneuverability over barge 10 than the previously used methods of attaching tow cables to barges and pulling them through the water. It will be appreciated by examination of FIGS. 1 and 2 that the connection procedure between 11 boat 14 and barge 10 of directing boat 14 into notch 12 and positioning boat 14 such that coupling unit 16, 16' can be extended to fit into channels 18, 18', virtually requires that this coupling and uncoupling to be conducted in reasonably calm water. Any substantial movement between boat 14 and notch barge would prevent proper alignment of the boat and barge thereby defeating connection of coupling unit 16, 16' to vertical channels 18, 18'. In addition, attempting to engage or disengage boat 14 and barge 10 in rough waters can lead to uncontrolled contact between boat 14 and barge 10 resulting in damage to both vessels. Therefore, it is necessary that the connection between boat 14 and barge 10 be made in calm waters. Once the connection is achieved and the arrangement of FIG. 2 is presented, the boat and barge unit can tolerate very rough seas. One report on the device shown in U.S. Pat. No. 4,688,507 indicated that a boat and barge unit coupled by such a device withstood and traveled through a storm having waves in excess of 35 feet.

While this report to indicates the strength and durability of this type of extended screw ram and channel connection between the boat and barge combination, it will also be appreciated that uncoupling and re-coupling the boat 14 and barge 10 in rough seas is dangerous and very unlikely to be successful. The lack of success in coupling the boat and barge combination during rough seas is a result of the rapid movement of both vessels in the rough waters and the difficulty in achieving sufficiently satisfactory alignment between boat 14 and barge 10 to allow coupling unit 16, 16' to be extended to interconnect with vertical channels 18, 18'.

Another drawback of the prior art just described is that once the boat 14 is connected with barge 10, the draft of barge 10—the amount, or depth, of barge 10 which is below water—cannot change appreciably. For example, if boat 14 connects with barge 10 while barge 10 is loaded and sitting low in the water (a deep draft), boat 14 will connect near the upper portion of vertical channels 18, 18'. If the barge is then unloaded without disconnecting boat 14, the barge will rise in the water and begin to lift the bow of boat 14 out of the water as the draft of barge 10 becomes more shallow. Conversely, if boat 14 connects with barge 10 while barge 10 is empty and barge 10 is then subsequently filled, the draft of barge 10 will increase and barge 10 will sink further down into the water. This could ultimately result in forcing boat 14 down into the water, and could result in sinking boat 14.

In many types of articulated boat and barge applications, the loading and unloading of barge 10 is not an issue. In these cases, boat 14 approaches and connects with barge 10 when it is already loaded. Boat 14 then pushes barge 10 to the desired location where boat 14 disconnects from barge 10 before it is unloaded. In these types of applications, the respective drafts of boat 14 and barge 10 do not change. However, there are types of applications in which it is desirable to connect boat 14 to an empty barge 10, then move the barge to a point where it can be loaded with a commodity, followed by moving the loaded barge to a different location where the commodity can be unloaded. If this sequence of events were to occur on a river or other relatively calm or protected waterway, it would not be difficult for boat 14 to disconnect from barge 10, wait for the barge to be loaded or unloaded, and the draft of barge 10 to change and stabilize, and then to reconnect boat 14 to barge 10. However, if this connection and reconnection between boat 14 and barge 10 is to take place on the open sea or in rough seas, this sequence of events cannot be effected as boat 14 and barge 10 are, generally, incapable of successfully uncoupling and recoupling in seas presenting even slight swells.

Therefore, a substantial need exists for a device and method of interconnecting a tug or pusher boat to a barge which permits the draft of the barge to change while allowing the connection between the pusher boat and the barge to compensate for the vertical movement of barge while avoiding any connecting and reconnecting of the boat and barge.

SUMMARY OF THE INVENTION

The present invention comprises a method and device for establishing engagement between a pusher boat and a barge which allows the boat and barge to remain engaged or connected while the position of the receiver is raised or lowered to compensate for changes in the draft of the barge during loading or unloading of the barge.

This is accomplished, generally, through a method of connecting the pusher boat and barge followed by adjusting the location of interconnection between the pusher boat and barge to compensate for changes in the draft of the barge while it is loaded or unloaded. The invention provides a vertically mobile engagement means or receiver device to which a coupling unit of a tug boat or pusher boat can connect. The engagement means or receiver is made vertically mobile by attaching it to a drive means which can vertically raise and lower the receiver or engagement means as needed. The drive means for the receiver can take the form of a screw drive, or a gear drive, or a hydraulic drive, or accomplished by use of a cable. The general object of the invention being to provide an engagement means which can move vertically in response to changes in the draft of the barge.

The foregoing and other objects are not meant in a limiting sense, and will be readily evident upon a study of the following specification and accompanying drawings comprising a part thereof. Other objects and advantages of this invention will become apparent from the following description taken in connection with the accompanying drawings, wherein is set forth by way of illustration and example, an embodiment of this invention.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

FIG. 3 is a cross-sectional view of a prior art coupling unit for securing a tugboat to a barge;

FIG. 4 shows the cast component or helmet of the coupling unit shown in FIG. 3 and the steel ball on which it is mounted;

FIG. 5 is a front-elevational view of the cast component or helmet of FIG. 4;

DESCRIPTION OF THE PREFERRED EMBODIMENTS

Figure 14:
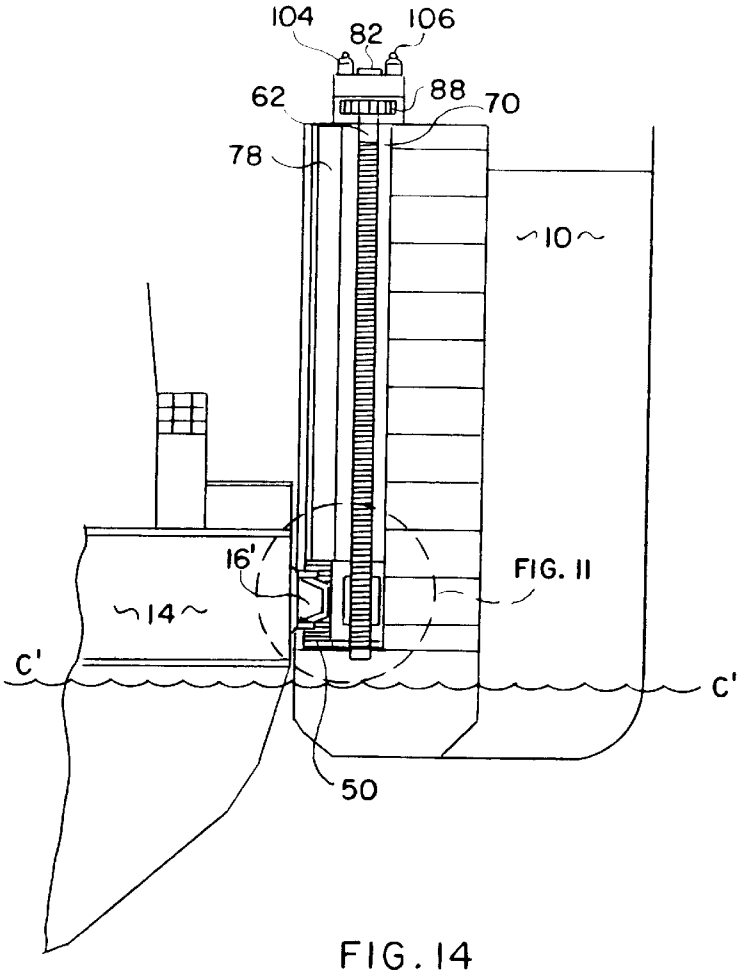
FIG. 14 is the cross-sectional view of FIG. 12 showing a tug boat with its coupling means inserted into the barge engagement means while the barge is fully unloaded.

The general functioning of the present invention will first be described by reference to FIGS. 12, 13 and 14. In FIG. 14 a barge 10 is shown which is fully unloaded and which, therefore, is riding high in the water as represented by waterline C'. This situation of barge 10 riding high in the water may also be described as barge 10 having a shallow draft. Referring now to FIG. 13, barge 10 is shown fully loaded and the added weight causes barge 10 to have a substantial portion of its mass below waterline A' and can be said to be "riding low in the water or having a deep draft. A comparison of the amount of barge 10 which is residing above the waterline as between FIGS. 13 and 14 will immediately provide an appreciation of the complexity of the problem faced by a tugboat or pusher boat 14 operator which is in connection with barge 10 while the barge is being loaded or unloaded. In the case of an empty barge which is being loaded with material, the barge will first ride high in the water as is shown in FIG. 14 and then as it is loaded it will progressively sink into the water until it reaches a fully loaded position as shown in FIG. 13.

In calm water this substantial change in the draft of barge 10 can be compensated for by disengaging tug 14 from barge 10 during the loading or unloading procedure to allow barge 10 to reach a new state of buoyancy according to the new barge load weight followed by reconnecting tugboat 14 to barge 10 once the new draft of barge 10 has become stabilized. Such connection and reconnection between boat 14 and barge 10 is limited to situations in which the vessels are located in calm water and rough seas are not compounding the difficulties of connecting boat 14 to barge 10. It will also be appreciated that the reverse situation of that just described is problematic for a tug and barge combined vessel. Specifically, if a boat 14 is attached to a barge 10 which is fully loaded as shown in FIG. 13, the boat must disconnect from the barge if the barge is being substantially unloaded. This is because the unloading of barge 10 will cause the draft of the barge to change and barge 10 will begin to ride higher in the water as shown in FIG. 14. If boat 14 does not disconnect from barge 10 and the connection point between boat 14 and barge 10 is in a fixed location, boat 14 will be pulled up out of the water as barge 10 rises in the water due to unloading. This will result in substantial damage to both boat 14 and barge 10 and the mechanisms connecting the two vessels. Again it will be appreciated that if barge 10 is being loaded and unloaded in calm waters that boat 14 can disengage from barge 10 during the loading or unloading procedure and reengage once the new level of buoyancy of barge 10 is established. However, this connection and reconnection cannot be accomplished in rough waters as the movement of both vessels caused by the wave action in a rough sea prevents proper alignment of boat 14 with the connection points on barge 10 and presents a situation in which substantial damage to the equipment and substantial danger to the lives and safety of crew members is presented.

Presently the loading and unloading of barges, such as those shown in FIGS. 13 and 14, on the open sea has become a commercially desirable option for dealing with transport of environmentally dangerous materials. In particular, in the to case of petroleum products, it is desirable that an empty barge be coupled to a boat and moved out into the open ocean to the location of an off-shore petroleum products terminal and loaded with a petroleum cargo. Alternatively, a similar situation is found with ocean-going super tankers. In this case it is desirable to move an empty barge into the open ocean or onto one of the Great Lakes and adjacent a larger tanker ship. Once near the tanker the barge can take-on a portion of the larger ships cargo to make the larger ship lighter. It is from this procedure that the term "lightering" is derived. Once the tanker ship has lightened its load and is riding higher in the water, the tanker itself can proceed to port for final unloading.

In both of these situations it is necessary that the barge be moved out into rough waters before it is loaded with cargo for its return trip to port. This loading will cause the draft of the barge to change dramatically after pusher boat 14 has become attached to barge 10. Since the loading of barge 10 is taking place on open ocean or rough waters, disconnection and reconnection of boat 14 to barge 10 is dangerous, if not impossible. Thus, it is critical to provide a means by which the draft of barge 10 is allowed to change while boat 14 remains connected to the barge and without boat 14 being pushed down into the water and sunk as the draft of barge 10 increases and barge 10 rides lower and lower in the water.

Figure 12:
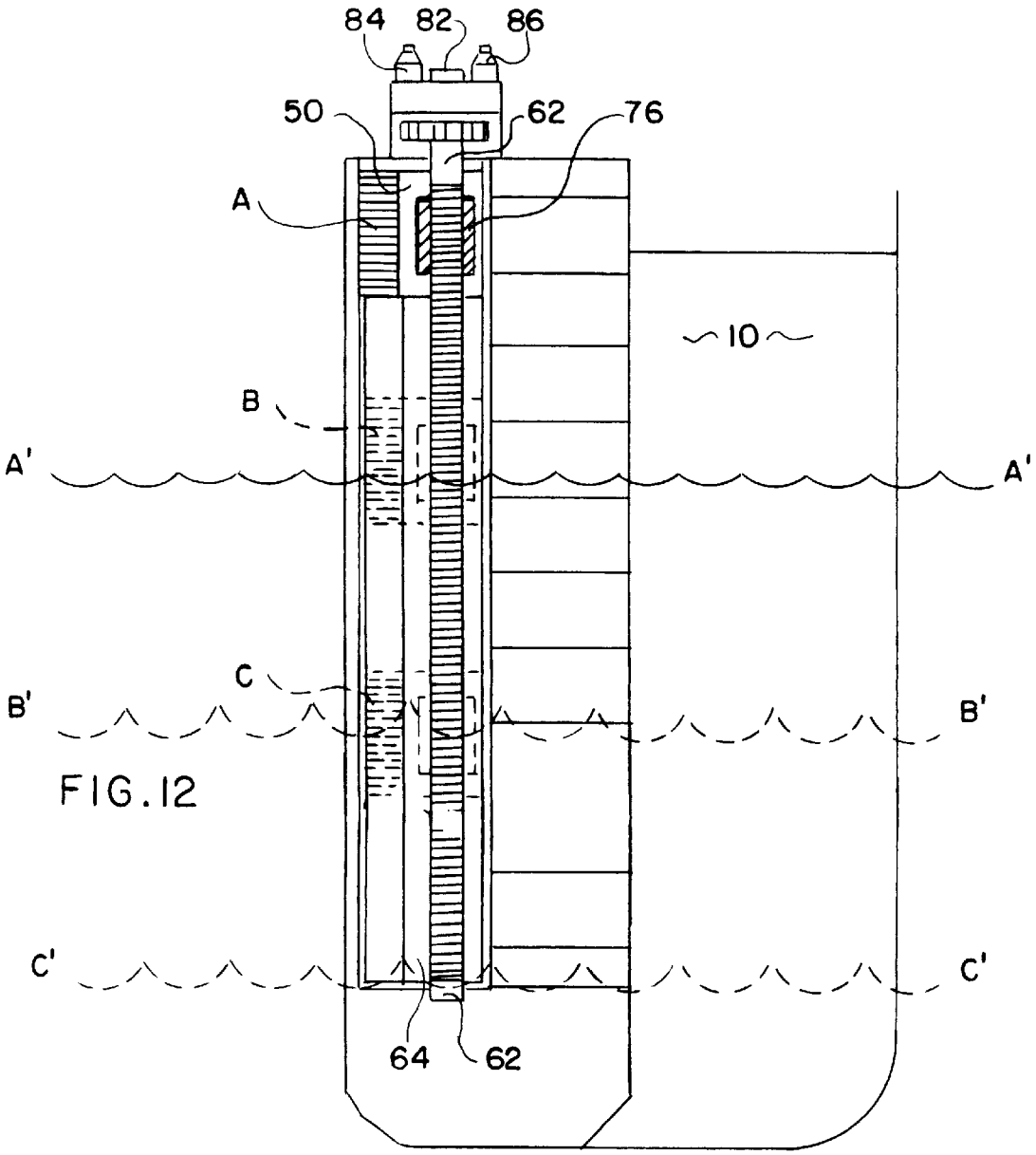
FIG. 12 is an elevational cross-sectional view of a barge equipped with the present invention and showing in solid lines the position of a barge engagement means raised to its uppermost position for use when the barge is fully loaded and also showing in phantom lines a position "B" for the engagement means which could be selected when the barge is partially loaded and the water line is at B prime and also showing in phantom lines a position "C" of the engagement means which would be used when the barge is empty and the water line is at a position represented by C'.
Figure 13:
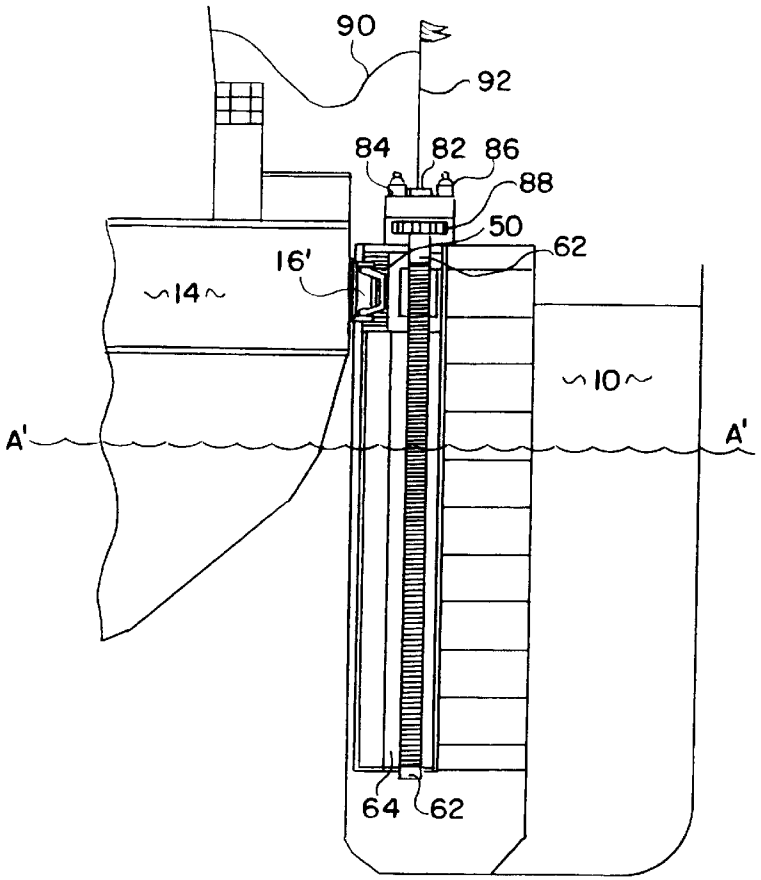
FIG. 13 is the cross-sectional view of FIG. 12 showing a tug boat with its coupling means inserted into the barge receiver, or engagement means, while the barge is fully loaded.

The solution, generally, to this problem of compensating for changes in the draft of a barge that is connected to a pusher boat or tug boat is shown in FIG. 12. In the case in which barge 10 is fully unloaded it will ride very high in the water and the waterline in such a case would be represented by phantom line C'. In this situation a tugboat or pusher boat 14 (FIG. 1) as it approached barge 10 and entered barge notch 12 (FIG. 1) would present its coupling unit to barge 10 at a height generally corresponding to Position C. Therefore, for boat 14 to couple with barge 10 it is necessary that the means for engagement of the coupling unit 16 of tug 14 be at a height corresponding to Position C. This is accomplished by raising or lowering receiver or repositionable engagement means (REM) 50 through the rotation of vertical screw drive 62 to which REM 50 is connected. Vertical screw drive 62 allows up-and-down movement of REM 50 within REM containment shaft 64.

Alternative situations are illustrated in FIG. 12, by way of example, of the case in which barge 10 is fully loaded and the draft has substantially increased thereby placing the waterline on barge 10 at A'. REM 50 will be repositioned through the use of vertical screw drive 62 to place REM 50 at location A. This location is at the upward extent of REM containment shaft 64. In this instance REM 50 is positioned to provide the same distance above the waterline A' as was achieved in the previous example in which REM 50 was placed at Arrow C to provide proper distance above waterline C'. In this manner tug 14 (FIG. 1) can approach and connect to barge 10 at whatever draft is presented by barge 10. Further, the connection can be achieved without tug 14 needing to make adjustments in its ballast to allow tug 14 to ride higher or lower in the water.

Another example of the repositionability of REM 50 is presented in FIG. 12 and which may be considered as the half-way position for a barge 10 which is only partially loaded. In this case the draft of partially loaded barge 10 would place the waterline at B' whereupon vertical screw drive 62 would be operated in order to place REM 50 into position B.

Another example illustrated by FIG. 12 is the situation in which tug 14 (FIG. 1) is continuously interconnected with barge 10 during the loading of barge 10. In this instance barge 10 would be completely unloaded and would be floating high in the water with the waterline represented at C'. As can be seen in FIG. 12 nearly all of barge 10 is above waterline C' in this empty state. In the procedure known as "lightering" this situation would be represented at the start of a tug and barge voyage where the tug is connected to an empty barge at a port. The tug would connect to the barge by approaching the barge and lowering REM 50 into position C to allow the tug or pusher boat 14 (FIG. 1) to connect securely to barge 10. With the boat connected to barge 10, the coupled or articulated tug and barge unit would proceed to sea and dock with an ocean terminal or a sea-anchored ocean tanker vessel. At this point the process of lightering can proceed.

In the case of an ocean tanker, part of the tanker's cargo or petroleum is off-loaded onto barge 10. As barge 10 receives the load from the tanker, it begins to increase its draft—or sink down in the water—and as the barge moves lower into the water, it becomes necessary to change the position of REM 50 in order to maintain barge 10 and tug 14 in a safe relationship and to avoid sinking tug 14 by the increasing draft of barge 10. To maintain this safe relationship, REM 50 is gradually moved from position C into position B and finally into position A when barge 10 is fully loaded. In this procedure tug 14 is able to remain in safe connection with barge 10 during the loading process. A comparison of this inventive adjustable connection with the connection between the vessels shown in FIG. 1 indicates the great benefits derived from the present invention. If the tug and barge combination of FIG. 1 were subjected to this lightering procedure, without disconnecting and reconnecting tug 14 to barge 10, the increasing draft of barge 10 drive tug 14 underwater. The alternative, while out at sea or in rough waters, would be for tug 14 to disconnect from barge 10 by retracting coupling units 16, 16' from vertical channels 18, 18' and await barge 10 to reestablished it draft in the water after being fully loaded. It would then be necessary for tug 14 to attempt to reconnect to barge 10 by following the procedure of FIGS. 1 and 2 by extending coupler unit 16, 16' into vertical channels 18, 18' to re-secure tug 14 with barge 10. This procedure is virtually impossible, and certainly dangerous, to perform at sea or in any waters have any significant degree of wave action. This disconnect and reconnect procedure is certainly dangerous in unprotected off-shore waters such as would be experienced at an off-shore terminal or near a sea anchored tanker ship.

Figure 6:
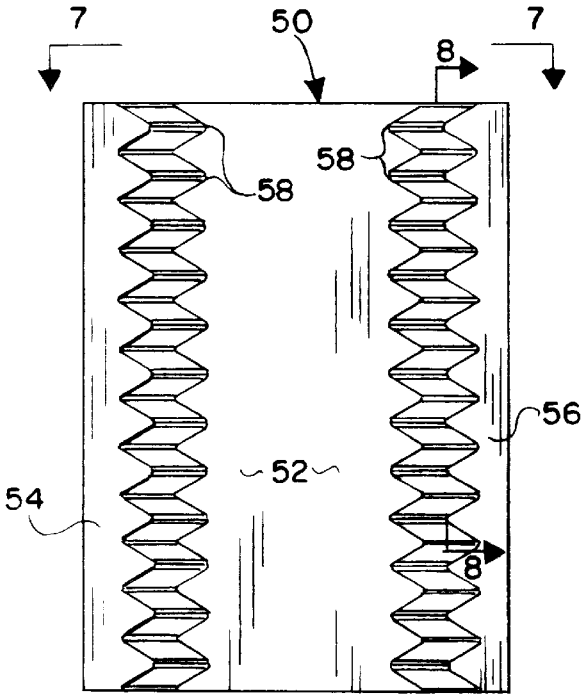
FIG. 6 is a front-elevational view of the mobile receiver or engagement means on the barge for receiving the coupling component of the tug.
Figure 7:
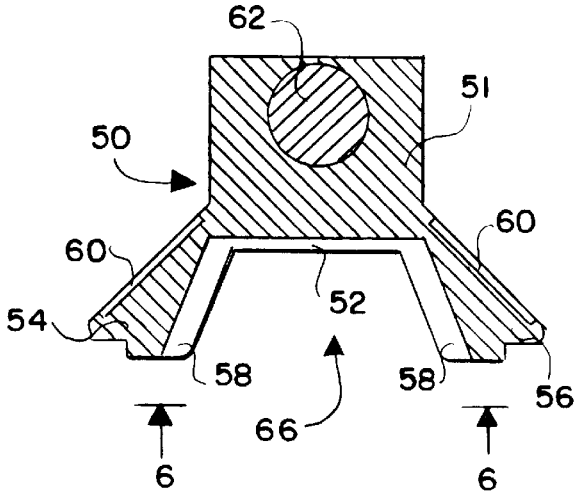
FIG. 7 is a top-plan view of the receiver shown in FIG. 6.

It will now be useful to describe in detail the preferred embodiments which particularly specify the manner in which the receiver or engagement means incorporated on a barge is raised and lowered to accommodate connection with a tug boat when the draft of the barge is changing. Referring now to FIG. 6 and 7, the construction of one preferred embodiment of receiver or repositionable engagement means (REM) 50 is shown. In FIG. 6 a front elevational view of REM 50 is shown. REM of FIG. 6 is complimentary in shape to the fixed, toothed-ladder positioned in vertical channels 18, 18' (FIG. 1) of the prior art. This similarity extends only to the use of teeth 58 on the fore and aft sides REM 50 to allow that connection to be made with a particular type of coupling unit 16. In particular, this coupling unit is described in U.S. Pat. No. 4,688,507 to Kuhlman et al, and which is incorporated herein by reference. It will be appreciated by those skilled in the art that alternative features maybe substituted for teeth 58 of FIG. 6.

One such alternative construction can be observed in FIGS. 3 and 4 of U.S. Pat. No. 5,050,522 to Yamaguchi et al. which also is incorporated herein by reference. In Yamaguchi FIGS. 3 and 4 a single tooth design is shown having the teeth extending from the area corresponding to back wall 52 shown in FIG. 6 of the present invention. Teeth 58 of REM 50 of the present invention would be eliminated in this alternative. Such a variation in construction of REM 50 could be made to allow REM 50 to be used with a coupling unit having a configuration as described in U.S. Pat. No. 5,050,522 to Yamaguchi et al.

Another alternative shape for use in REM 50 is shown in U.S. Pat. No. 5,050,522 to Yamaguchi et al at FIG. 4 wherein a slotted engagement means incorporating securing pins 21, 22 might be substituted for teeth 58 of the present embodiment to allow the present invention of be utilized with this alternative form of coupling unit where it is already installed in a tug boat or pusher boat. It will be appreciated that the shape or design of the coupler helmet and the surface of the REM need to correspond to achieve engagement between a boat coupling unit 16, 16' (FIG. 1) and the repositionable engagement means of the present invention. Therefore, variations in the shape of the interior surface of REM 50 are contemplated as being well within the scope of the present invention and are mere design choices to be interchanged as needed.

Figure 8:
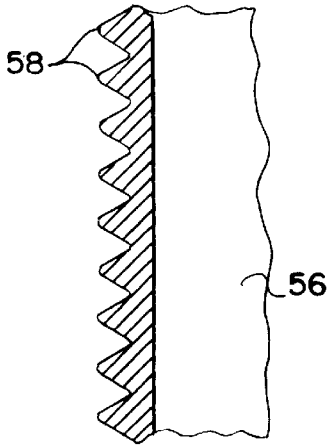
FIG. 8 is a fragmentary cross-sectional view taken along line 8—8 of FIG. 6 and showing the arrangement of the teeth on the receiver or engagement means.

Referring again to FIG. 6 the embodiment of the present invention illustrating the use of teeth 58 for capturing a coupling unit will be further described. As shown in FIG. 6 repositionable engagement means REM 50 is a unit which is on the order of 6 to 8 feet in height and having teeth 58 on the fore and aft sides of REM 50 to receive teeth 48 of cast component or helmet 30 (FIG. 5). A comparison of a cross-sectional view of teeth 58 of FIG. 8 with teeth 48 shown on either side of helmet 30 will provide an appreciation of the close interlocking fit which occurs between teeth 58 of REM 50 of FIG. 6 and teeth 48 on either side of helmet 30. The close fitting engagement between these teeth provides a secure connection between the pusher boat 14 and barge 10.

Figure 9:
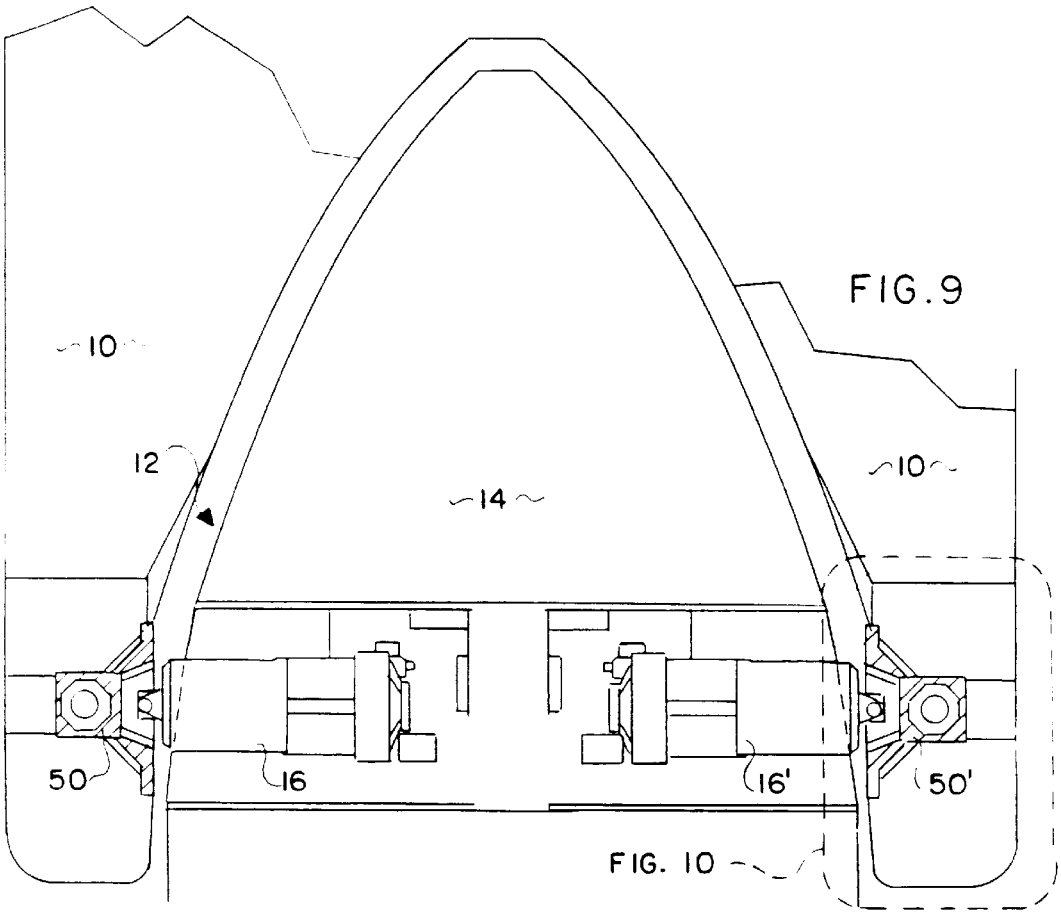
FIG. 9 is a cross-sectional view taken along line 10—10 of FIG. 11 and showing, in full, a tug or pusher boat seated within the notch of a barge and having the coupling means of the barge extended into the mobile ladder or engagement means of the barge.

Referring now to FIG. 7 it will be further appreciated that teeth 58 are angled inwardly toward back wall 52 of REM 50. This, generally, "V-shaped" configuration of REM 50 provides a close mechanical fit between REM 50 and helmet 30 (FIG. 5) as helmet 30 is extended from tug 14 (FIG. 1) to connect with REM 50. The 11 close and secure mechanical fit which is derived from this arrangement can be better appreciated in FIG. 9 in which a cross-sectional view of a joined tug 14 and barge 10 is shown. When tug 14 is positioned within notch 12 of barge 10 that coupling units 16, 16' on the port and starboard of tug 14 can be extended into REMs 50 on the port and starboard walls of notch 12 and pressed into the "V-shaped" opening 66 (FIG. 7) presented by REM 50 to provide a secure fit and capture of barge 10 by tug 14.

Still referring to FIG. 7, REM body 51 has a central void through which screw drive 62 passes. This relationship is also shown in vertical cross-sectional view in FIG. 11. Body 51 is able to ride up and down on screw drive 62 to position REM 50 as required. Attached to sidewalls 54, 56 are non-sparking load facing 60. During repositioning of REM 50 movement of body 51 adjacent barge load plate 78 (FIG. 11) could produce sparks. To avoid this dangerous situation, sidewalls 54, 56 are provided with a non-sparking facing or surface such a bronze.

This procedure of capturing barge 10 by tug 14 would occur most often when barge 10 was empty and having a shallow draft. This initial capture of an empty barge is shown in FIG. 14 in which barge 10 is unloaded and riding high in the water with tug 14 connecting to REM 50 which has been positioned near waterline C' so REM 50 is aligned with coupling unit 16, 16' of tug 14 for receiving helmet 30 of coupling unit 16,16'. Once this connection has been completed with the present invention, it will be possible for barge 10 to then be fully loaded with a substance and sink down into the water while allowing the point of connection between tug 14 and barge 10 to be changed in its vertical position without disconnecting tug 14 from barge 10. This final result is shown in FIG. 13 where REM 50 has been moved vertically through the use of vertical screw drive 62 to ultimately position REM 50 near the top of vertical screw drive 62 once barge 10 has become fully loaded.

Figure 10:
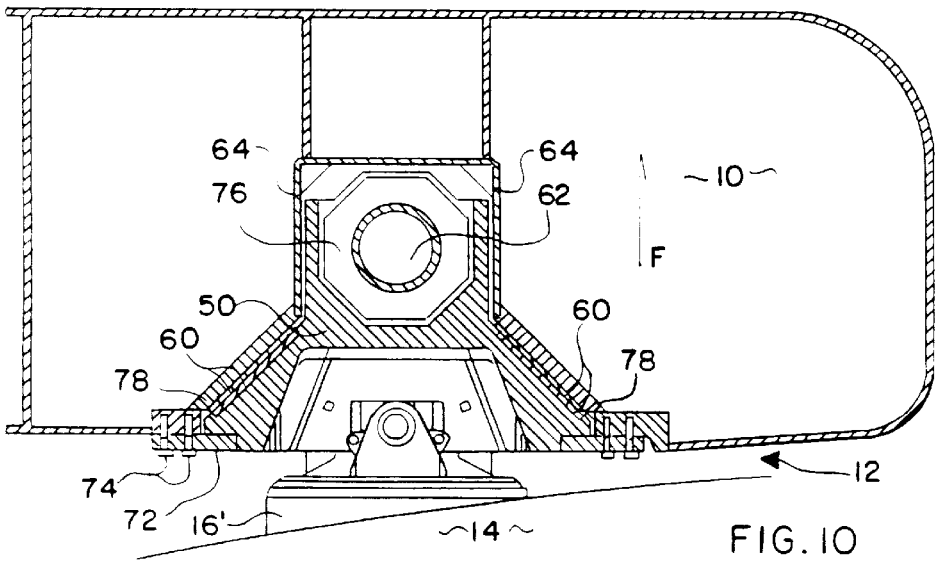
FIG. 10 is an enlarged view of the indicated area of FIG. 9 and showing the insertion of the tug coupling means into the barge engagement means.
Figure 11:
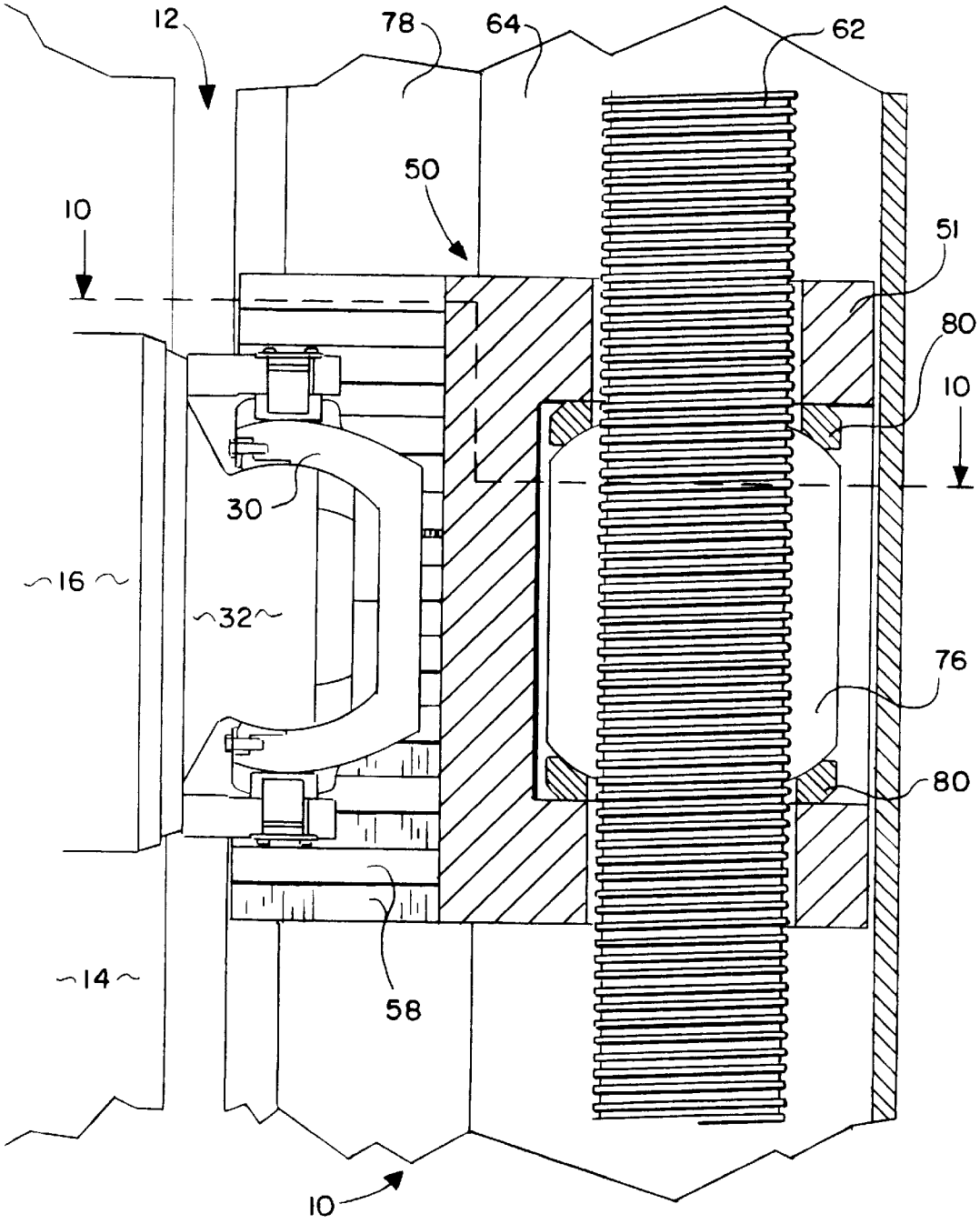
FIG. 11 is an enlarged elevational cross-sectional view of the indicated area of FIG. 14 and showing the tug coupling means inserted into the barge engagement means and showing a screw drive of a preferred embodiment for raising and lowering the barge receiver or engagement means.

Reference is now made to FIG. 11 which is an enlarged view of the cross-sectional area indicated in FIG. 14. In FIG. 11 coupling unit 16 is shown inserted into REM 50 so teeth 48 (not shown) of helmet 30 engage with teeth 58 of REM 50. As shown in FIG. 11, REM 50 and vertical drive screw 62 are connected and contained within vertical drive containment 64. Vertical drive containment 64 is a vertical open shaft on the inboard port and starboard sides of notch 12 (FIG. 9) and which is designed to permit REM 50 to move upwardly and downwardly on the vertical drive means which is selected for use with REM 50. As will be described hereinafter, vertical drive means can be a screw drive, or a gear drive, or a hydraulic drive, or cables may be used to hoist REM 50 up and down. Referring again to FIG. 11, additional containment and load bearing for the operation of REM 50 is provided by load plate 78 which is closely spaced to REM 50 and which is equipped with a non-sparking load facing 60 (FIG. 10) which contacts a second non-sparking load facing 60 (FIG. 10) attached to REM 50. (FIG. 10).

Referring now to FIG. 10, it will be appreciated that as coupling unit 16 is inserted into REM 50, pressure is exerted against REM 50 which tends to force REM 50 outwardly and away from tug 14 as it is seated in notch 12. It is desirable and important that the pressure exerted by coupling unit 16, 16' not interfere with the operation of the vertical drive means, in this case vertical screw drive 62. Such interference is avoided by the close spacing of load plate 78 to either side of REM 50. In operation, as coupling unit 16, 16' advances into REM 50, both coupling unit helmet 30 and REM 50 are forced outwardly in the direction of Arrow F. This outward force is then received by load plate 78 which serves to resist the outward force prior to the outward force affecting the operation of the vertical drive means, in this case in particular, vertical screw drive 62. Once coupling unit 16 has advanced sufficiently to securely couple with REM 50, movement of coupling unit 16, 16' (FIG. 9) is terminated and it is locked into position for the voyage. Removal of coupling unit 16, 16' from REM 50 is a reverse of the above-described operation. The operator of tugboat 14 reverses the direction of the drive used to advance and retract coupling unit 16, 16' and helmet 30 is pulled into tug 14. During the disengagement procedure, REM 50 is held into place by retainer plate 72 on either side of REM 50 which is attached to barge 10 by retainer bolt 74.

Referring again to FIG. 11, REM 50 is mounted on vertical screw drive 62 which passes through the rear half of REM 50. As seen in the cross-sectional view of FIG. 11, REM 50 rides up and down on vertical screw drive 62 by the reception of screw drive 62 into vertical control nut 76 which is contained within REM 50. In this manner as screw drive 62 is rotated in a counter clockwise direction, REM 50 will travel downwardly, and when screw drive 62 is rotated in a clockwise direction, REM 50 will be raised vertically. In order to maintain vertical control nut 76 in centered alignment with vertical screw drive 62, spherical alignment washers 80 are positioned at the top and bottom of control nut 76.

Referring now to FIG. 13, vertical screw drive 62 is shown mounted in vertical drive containment 64 with REM 50 raised to the top-most extent of the screw drive 62 shaft. When it is desired to change the height of REM 50 with respect to its position on barge 10, a crew member on tug 14 activates one of two motor drives to rotate vertical screw drive 62 in the direction selected. In FIG. 13, 84 is a low-speed motor which will rotate vertical screw drive 62 to raise or lower REM 50 at approximately six inches per minute, and high-speed motor 86 will rotate vertical screw drive 62 to raise or lower REM 50 at an approximate speed of 12 inches per minute. It will be appreciated that, alternatively, a single multiple-speed drive motor could be substituted for the use of a high-speed and a low-speed motor as shown in FIG. 13. Upon activation of either motor 84 or motor 86, the force generated by the motor travels through a gear train to reach gear 88 which is attached to, and rotates, screw drive 62. The signaling by the crew member of tug 14 to activate REM 50 is accomplished by use of an umbilical cord 90 which communicates operations signals and operational power for motors 84, 84 from tug 14 across to barge 10. In this manner, dependable hardwire communication is accomplished between tug 14 and motors 84, 86. Once the rotation of vertical screw drive 62 has moved REM 50 to the desired location, a brake apparatus (not shown) attached to the drive train of motors 84, 86 is activated to stop the rotation of vertical screw drive 62 and to maintain REM 50 in the selected location. A wide variety of different types of brakes can be applied to the present invention. The particular form of the brake can be selected by the user. By way of example, and not limitation, a disc brake could be connected into the drive train or a shoe-type brake design could be applied against the screw drive of the preferred embodiment of FIG. 13.

The control of the operation of screw drive 62 is accomplished by the use of two measuring devices. The first, a load cell or strain gauge, allows determination of the vertical forces on screw drive 62. The second device, an encoder on the gear train, determines the quantity, and direction and speed of rotation of screw drive 62. The load cell is mounted in housing 82 at the upper-most end of screw drive 62. As the draft of barge 10 changes, the barge moves up or down in the water. This generates a commensurate upward or downward pressure on REM 50 from tug 14 being pushed down into the water due to the increasing weight of the loading barge, or by tug 14 being lifted up out of the water as barge 10 becomes lighter during unloading. This received force is communicated by REM 50 to screw drive 62, and, in turn, to the load cell in housing 82 where the pressure is measured. The pressure against the load cell is communicated to tug 14 to allow the pilot to determine if the position of REM 50 should be raised or lowered to reduce the upward or downward force on screw drive 62.

The control of the amount of rotation, and the direction and speed of rotation of screw drive 62 is tracked by use of an encoder which is coupled to the upper end of the gear train which connects motor 44, 46 to screw drive 62. The encoder operates to determine, or count, the number of rotations of one of the rotating shafts of the gear train. This then permits the computing of the direction of rotation of screw drive 62 and the total upward or downward distance traveled by REM 50. The encoder reading can be set to zero by the pilot to permit determinations of relative distance of movement by tug 14 from a starting point. In addition, by tracking the rotations over time the encoder permits determinations of revolutions-per-minute of screw drive 62.

Figure 16:
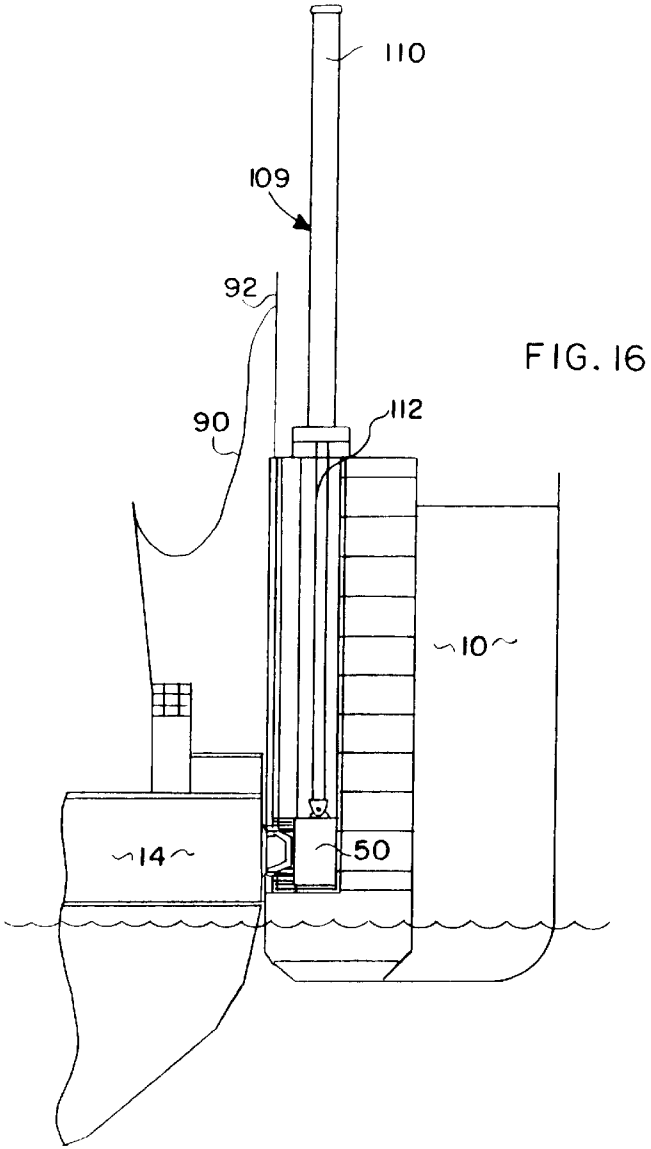
FIG. 16 shows a preferred embodiment in which a hydraulic cylinder is used to raise and lower the receiver or engagement means.
Figure 15:
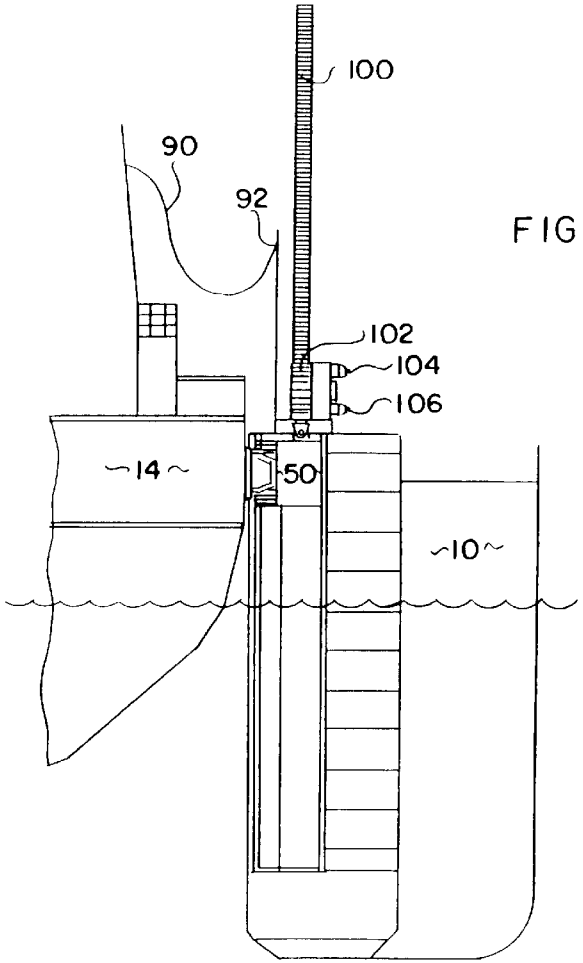
FIG. 15 shows a preferred embodiment in which the engagement means of the tug is raised and lowered by use of a pinion and rack gear arrangement to adjustment in the height of the receiver or engagement means.

Referring now to FIGS. 15 and 16, two other preferred embodiments of the present invention are shown. In FIG. 15, an embodiment is shown utilizing a rack-and-pinion gear system to raise and lower REM 50. In operation of the embodiment of FIG. 15, the tug operator transfers a signal through umbilical 90 to pennant 96 which activates either low-speed motor 104 or high-speed motor 106 which rotates pinion 102 in the selected direction. The rotation of pinion 102 will move rack 100 either upwardly or downwardly as is required to reposition REM 50 at the desired location.

Referring now to FIG. 16, a preferred embodiment is shown in which the vertical drive means is a hydraulic cylinder. In the embodiment of FIG. 16, the rack-and-pinion vertical drive means of FIG. 16 has been replaced by a hydraulic cylinder 109. In operation of this embodiment, a hydraulic ram 112 is attached to REM 50 and in response to commands from tugboat 14 along umbilical 90 to pennant 92 hydraulic ram 112 is retracted or extended from hydraulic cylinder 110 in order to raise and lower REM 50 to the desired position with respect to barge 10.

A further preferred embodiment for the vertical drive means or vertical repositioning means is the cable or hoist embodiment. In this embodiment REM 50 is moved from vertical position to vertical position by the use of a cable which is attached to REM 50. The cable can be attached to a device as simple as a capstan to accomplish lengthening or shortening of the cable to place REM 50 in the desired vertical. In practical application, however, a wench drive would be used to raise or lower REM 50 as required.

In the foregoing description, certain terms have been used for brevity, clearness and understanding but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the improved repositionable engaged means is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween. Particularly, it is to be understood that in the claims, ingredients or compounds recited are intended to include compatible mixtures of such ingredients.

Having thus described the invention what is claimed as new and desired to be secured by Letters Patent is as follows:

1. An apparatus for joining a barge including a well in the stern thereof with a pusher boat-mounted coupler comprising:

at least two receivers adapted to be mounted bilaterally on the barge well, said receivers being vertically repositionable and adapted for connection with the pusher boat coupler, and means for vertically repositioning said receivers to vary the vertical location of said receivers with respect to the barge.

2. The apparatus as claimed in claim 1 wherein said means for vertically repositioning said receivers is a hydraulic piston attached to said receivers to raise and lower said receivers.

3. The apparatus as claimed in claim 1 wherein said means for vertically repositioning said receivers is a cable attached to said receivers to raise and lower said receivers.

4. The apparatus as claimed in claim 1 wherein said means for vertically repositioning said receivers is a gear drive attached to said receivers to raise and lower said receivers.

5. The apparatus as claimed in claim 1 wherein said means for vertically repositioning said receivers is a screw drive attached to said receivers to raise and lower said receivers.

6. The apparatus as claimed in claim 3, 4 or 5 further comprising a brake for stopping said repositioning means upon said receivers reaching a desired vertical position.

7. The apparatus as claimed in claim 1 further comprising a guide to support each of said receivers and to direct the vertical repositioning of said receivers.

8. The apparatus as claimed in claim 1 further comprising at least one load bearing plate attached to at least one of said receivers for resisting the force of the coupler during engagement of the coupler with said receiver.

9. The apparatus as claimed in claim 1 further comprising at least one non-sparking facing plate for spacing at least of one of said receivers from adjacent surfaces for reducing spark generation as said receiver is repositioned.

10. An apparatus to maintain a joined relationship between a barge including a well in the stern thereof and a coupling unit of a pusher boat during changes in the draft of the barge comprising:

a pair of vertically repositionable receivers each mounted on a guide, said guides adapted to be mounted bilaterally on the barge well, said receivers being adapted for engagement with the pusher boat coupling unit to form the joined relationship between the barge and the pusher boat, means for adjusting the vertical position of each of said receivers within said guides.

11. The apparatus as claimed in claim 10 further comprising at least one non-sparking facing plate to space at least one of said receivers from said guide to reduce spark generation as said receiver is moved during repositioning.

12. The apparatus as claimed in claim 10 wherein said means for adjusting the vertical position of said receivers is a hydraulic piston attached to said receivers to raise and lower said receivers.

13. The apparatus as claimed in claim 10 wherein said means for adjusting the vertical position of said receivers is a cable attached to said receivers to raise and lower said receivers.

14. The apparatus as claimed in claim 10 wherein said means for adjusting the vertical position of said receivers is a gear drive attached to said receivers to raise and lower said receivers.

15. The apparatus as claimed in claim 10 wherein said means for adjusting the vertical position of said receivers is a screw drive attached to said receivers to raise and lower said receivers.

16. The apparatus as claimed in claim 13,14 or 15 further comprising a brake for stopping said repositioning means upon said receivers reaching a desired vertical position.

17. The apparatus as claimed in claim 10 further comprising at least one load bearing plate attached to at least one of said receivers for resisting the force of the coupling unit during engagement of the coupling unit with said receiver.

18. A method of adjusting for changes in the draft of a barge including a well in the stern thereof by a pusher boat joined to the barge with a pusher boat-mounted coupling unit, the method comprising the steps of:

connecting the pusher boat coupling unit to a pair of bilaterally well-mounted vertically repositionable receivers when the barge is at a first barge draft position, and operating a means for vertically repositioning said well-mounted receivers to reposition said receivers in response to the barge changing from said first barge draft position to a second barge draft position such that a safe pusher boat draft is at all times provided.

19. The method as claimed in claim 18 wherein said means for vertically repositioning said receivers is a hydraulic piston attached to said receivers to raise and lower said receivers.

20. The method as claimed in claim 18 wherein said means for vertically repositioning said receivers is a cable attached to said receivers to raise and lower said receivers.

21. The method as claimed in claim 18 wherein said means for vertically repositioning said receivers is a gear drive attached to said receivers to raise and lower said receivers.

22. The method as claimed in claim 18 wherein said means for vertically repositioning said receivers is a screw drive attached to said receivers to raise and lower said receivers.

23. A method of retaining connection between a barge including a well in the stern thereof and a coupling unit of a pusher boat while compensating for changes in the draft of the barge, the method comprising the steps of:

providing a pair of receivers mounted bilaterally on the barge well, said receivers being adapted to join with the coupling unit of the pusher boat, and said receivers further being capable of being repositioned vertically with respect to said barge, connecting to said receivers a means for vertically repositioning said receivers, joining the pusher boat coupling unit with said barge receivers at a first receiver position while the barge is at a first barge draft position, and moving said receivers from said first receiver position to a second receiver position by operation of said means for vertically repositioning said recievers to change the vertical position, with respect to the barge, of said receivers and the joined coupling unit in response the barge draft changing from said barge draft position to a second barge draft position.

24. The method as claimed in claim 23 wherein said means for vertically reposition said receivers is a hydraulic piston attached to said receivers to raise and lower said receivers.

25. The method as claimed in claim 23 wherein said means for vertically repositioning said receivers is a cable attached to said receivers to raise and lower said receivers.

26. The method as claimed in claim 23 wherein said means for vertically repositioning said receivers is a gear drive attached to said receivers to raise and lower said receivers.

27. The method as claimed in claim 23 wherein said means for vertically repositioning said receivers is a screw drive attached to said receivers to raise and lower said receivers.

28. A method of maintaining interconnection between a barge including a well in the stern thereof and a coupling unit of a pusher boat while compensating for changes in the draft of the barge during loading or unloading of the barge comprising the steps of:

joining the pusher boat to a pair of receivers mounted bilaterally on the barge well, said receivers being at a first receiver position, to provide interconnection between the pusher boat and the barge, modifying the load of the barge such that a change in the draft of the barge results, operating a means for vertically repositioning said receivers to move said receivers from said first receiver position to a second receiver position to maintain an operable pusher boat draft while allowing the barge draft to change in response to said step of modifying the load of the barge.

29. The method as claimed in claim 28 wherein said means for vertically repositioning said receivers is a hydraulic piston attached to said receivers to raise and lower said receivers.

30. The method as claimed in claim 28 wherein said means for vertically repositioning said receivers is a cable attached to said receivers to raise and lower said receivers.

31. The method as claimed in claim 28 wherein said means for vertically repositioning said receivers is a gear drive attached to said receivers to raise and lower said receivers.

32. The method as claimed in claim 28 wherein said means for vertically repositioning said receivers is a screw drive attached to said receivers to raise and lower said receivers.

33. An apparatus for joining a pusher boat-mounted coupler with a barge including a well in the stern thereof, the pusher boat-mounted coupler including a pair of axially aligned rams on opposite sides of the pusher-boat, each ram being supported on the vessel for extension and retraction, each ram including a head on an outer end, said apparatus comprising:

a pair of vertically elongated guides on opposite sides of the well, a receiver within each of said guides adapted for receiving the heads when the heads are extended into said guides, to couple the pusher boat with the barge in a manner permitting only relative pitch movement therebetween about a horizontal pitch axis extending between the rams, means for vertically repositioning said receivers to vary the vertical location of said receivers within said guides, a brake for stopping said repositioning means upon said receivers reaching a desired vertical position, at least one load bearing plate for resisting the force of the coupler during engagement of the coupler with at least one of said receivers, and at least one non-sparking facing plate for spacing at least one of said receivers from adjacent surfaces for reducing spark generation as said receiver is repositioned.

* * * * *

UNITED STATES PATENT AND TRADEMARK OFFICE

CERTIFICATE OF CORRECTION

PATENT NO. : 6,199,501 B1
DATED : March 13, 2001
INVENTOR(S) : Kuhlman

Figure 1:
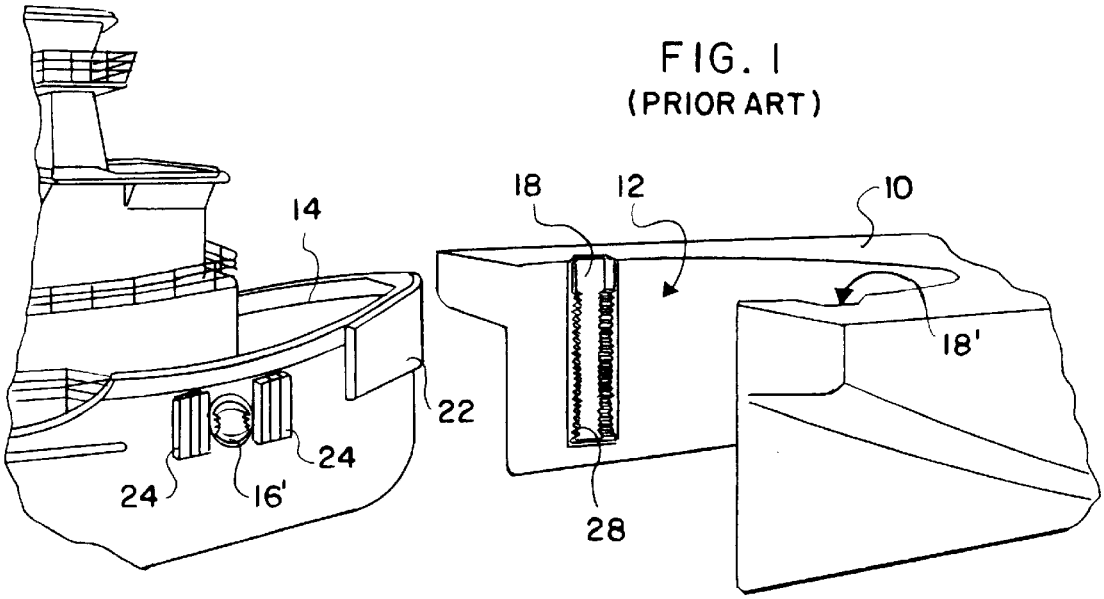
FIG. 1 (PRIOR ART)
FIG. 1 shows, generally, a prior art connection in which a tug boat or pusher boat is aligned with a barge having a stern well or notch for receiving the tug.
Figure 2:
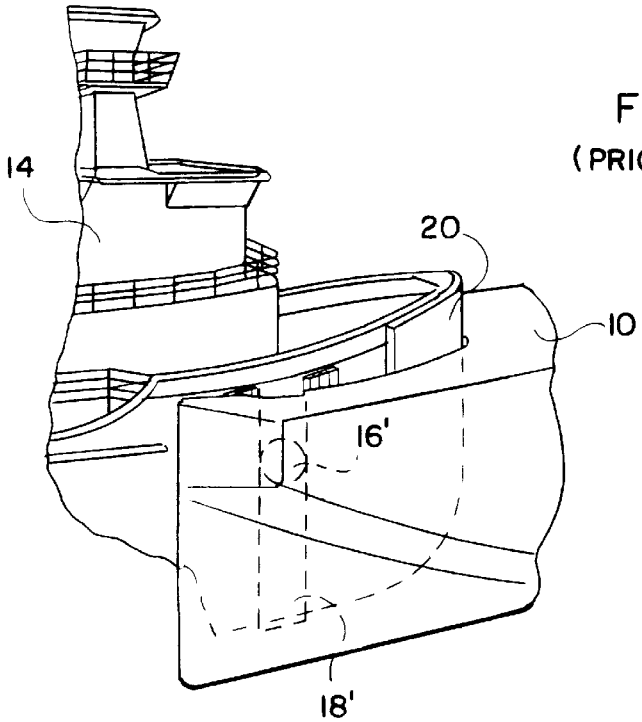
FIG. 2 (PRIOR ART)
FIG. 2 shows the components in FIG. 1 in final alignment with the tug seated in the barge notch and showing, in phantom lines, the alignment of the tug coupling unit with the barge vertical channels.

It is certified that error appears in the above-identified patent and that said Letters Patent is hereby corrected as shown below:

Column 2,
Line 9,"FIGS. 1 and 2, should read -- FIGS. 1 and 2 that the connection procedure between boat .

Column 8,
Line 18, "The 11 close and secure"; should read -- The close and secure--.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*